United States Patent [19]

Isherwood

[11] 4,369,906

[45] Jan. 25, 1983

[54] WEB FEEDING MACHINES

[75] Inventor: Jeffrey Isherwood, Enfield, England

[73] Assignee: Crosfield Electronics Limited, London, England

[21] Appl. No.: 273,151

[22] Filed: Jun. 12, 1981

[30] Foreign Application Priority Data

Jun. 19, 1980 [GB] United Kingdom ..... 8020092

[51] Int. Cl.[3] ..... B65H 17/18; B65H 23/18

[52] U.S. Cl. ..... 226/42; 226/4; 226/24; 226/27; 226/108

[58] Field of Search ..... 226/42, 24, 27, 28, 226/29, 30, 31, 10, 108, 4

[56] References Cited

U.S. PATENT DOCUMENTS

| | | | |
|---|---|---|---|
| 3,179,045 | 4/1965 | Evers | 226/108 X |
| 3,800,992 | 4/1974 | Yamagishi | 226/108 X |
| 3,955,737 | 5/1976 | Traise | 226/108 |
| 4,124,156 | 11/1978 | Waffner | 226/108 X |

FOREIGN PATENT DOCUMENTS

| | | | |
|---|---|---|---|
| 1221000 | 7/1966 | Fed. Rep. of Germany | 226/108 |
| 2149754 | 4/1973 | Fed. Rep. of Germany | 226/108 |
| 1346418 | 2/1974 | United Kingdom | 226/108 |

*Primary Examiner*—Stanley N. Gilreath

*Attorney, Agent, or Firm*—Sughrue, Mion, Zinn, Macpeak and Seas

[57] ABSTRACT

A web feeding machine for controlling the feed of a web of material comprises a first pair of rollers which bear against one another to form a first nip, a second pair of rollers which bear against one another to form a second nip downstream from the first nip, means to cause the ratio of the linear speed of the web through the second nip to that through the first nip to be a constant and to have a value greater than one, a variable speed drive for driving the nip rollers, means for monitoring the tension $T_1$ in the web upstream from the first nip and the tension $T_2$ between the first and second nips, and control means to control the variable speed drive of the rollers so that the angular velocity $\omega$ of the rollers satisfies the expression:

$$\frac{\omega A(T_2 - T_1)}{B\,T_2 - T_1} = C$$

where A, B and C are constants. By controlling the angular velocity of the rollers and hence the linear speed of the web in accordance with this expression, a constant flow rate of the web is ensured irrespective of the elasticity of the web or the overall speed of its feed.

4 Claims, 1 Drawing Figure

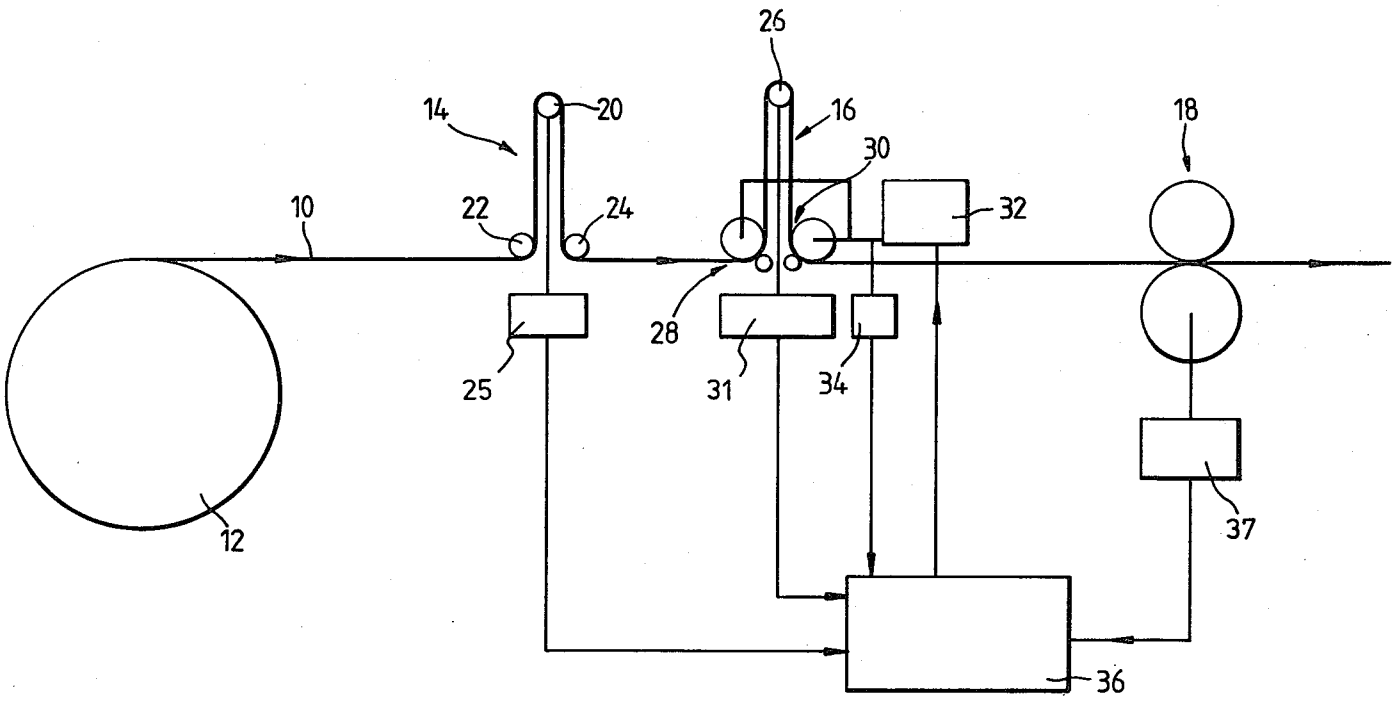
18
37
36
32
30
16
26
34
31
28
20
24
14
22
25
10
12

WEB FEEDING MACHINES

This invention relates to web feeding machines for controlling the feed of a web of material from, for example, a supply reel or one web processing machine to a web treating machine such as a printing press. Typically the material is paper but it may also be card, board, or a film of plastics material.

Taking as an example the material being paper passing from a supply reel to a printing press, then various parameters of the paper vary as it is unwound from the reel. The variations that occur in the parameters of the paper as it is unwound from the reel may be caused by changes in temperature and humidity. During storage of the reel the outer windings may absorb moisture from the air and so have a greater extensibility and thus strain more easily than the inner windings. The tension on the web and its strain, have to be controlled closely if proper registration of the printing on the web is to be obtained. This is especially important when the web is subjected to successive overprinting with ink of different colours and to obtain correct registration of printing and subsequent processing when, for example, the printed web is punched or embossed. If subsequent lengths of web are printed whilst strained to a different extent they differ in final length after they have subsequently stabilised.

The most common method of controlling the feed of web to a printing press is to maintain a constant tension in the web fed to the printing press. In this case, if the extensibility of the web changes by, for example, the web from the outer layers of the storage reel having a greater water content, a given constant tension causes greater strain.

This leads to the prints obtained from the more extensible parts of the web shrinking after they have been printed.

More recently, more sophisticated attempts have been made to control the feed of a web of material to a web of a processing machine and one of these which applies a constant strain to the web is described in British Pat. No. 1 484 185. In the apparatus disclosed in this specification the elastic modulus of the web is measured and then the tension applied to the web upstream of the web processing machine is controlled in dependence upon the elastic modulus of the web to provide a constant strain or elongation of the web upstream of the web processing machine. This apparatus provides better control but, to enable the tension in the web upstream from the processing machine to be controlled, the web processing machine must include a nip through which the web is drawn. Thus, this apparatus is not suitable for a blanket to blanket offset printing press, in which slip of the web can occur nor for printers of the ink jet-type which do not include a nip. Where the printing press, or other web processing machine, does include a nip, there may still be changes in the ink friction characteristics, impression pressures, roller hardness or paper properties which affect the tension and so upset the correct feed of the web.

According to this invention, a web feeding machine for controlling the feed of a web of material comprises a first pair of rollers which bear against one another to form a first nip, a second pair of rollers which bear against one another to form a second nip downstream from the first nip, means to cause the ratio of the linear speed of the web through the second nip to that through the first nip to be a constant and to have a value greater than one, a variable speed drive for driving the nip rollers, means for monitoring the tension $T_1$ in the web upstream from the first nip and the tension $T_2$ between the first and second nips, and control means to control the variable speed drive of the rollers so that the angular velocity $\omega$ of the rollers satisfies the expression:

$$\frac{\omega A(T_2 - T_1)}{B\,T_2 - T_1} = C$$

where A, B and C are constants.

By controlling the angular velocity of the rollers and hence the linear speed of the web in accordance with this expression, a constant flow rate of the web is ensured irrespective of the elasticity of the web or the overall speed of its feed. Thus, each length of the web leaving the second nip during unit time has the same length when measured at zero tension. The feed of the web from the second nip is completely independent of the nature of any web processing machine located downstream and thus, when a press is located downstream of the second nip and irrespective of whether that printing press includes a nip, the final, stabilised, printed copies have a substantially constant repeat length when measured at zero tension.

Let $V_1$ and $V_2$ be the linear speed of the web at the first and second nips respectively, then the web elasticity K is equal to:

$$K = \frac{\text{web tension}}{\text{web elongation}}$$

For a constant rate of flow of the web through the two nips $$V_1\left(1 - \frac{T_1}{K}\right) = V_2\left(1 - \frac{T_2}{K}\right)$$

and therefore $$K = \frac{T_2 V_2 - T_1 V_1}{V_2 - V_1}$$

If X equals the ratio of the linear speed at the two nips so that $V_2{:}V_1 = X{:}1$ and thus $V_2 = X\,V_1$ then $$K = X\frac{T_2 - T_1}{X - 1}$$

Therefore, substituting for K in the equation for the flow rate of the web we get that the flow rate of the web equals $$V_1 - \frac{V_1\,T_1\,(X - 1)}{X\,T_2 - T_1}$$

The velocity of the web V through the nip is equal to: $V = \omega\pi d$ where $\omega$ is the angular velocity and d is the diameter of a roller forming the nip. Therefore, the flow rate per unit time L is given by $$L = \frac{\omega_1\,\pi\,d_1\,X\,(T_2 - T_1)}{X\,T_2 - T_1}$$

For a particular apparatus the diameter of the nip rollers is constant and the ratio of the linear speed is also constant. Thus:

$$L = \frac{A\omega_1 (T_2 - T_1)}{B\,T_2 - T_1}$$

where A and B are constants.

Thus, L, the flow rate per unit time, can be held constant by modifying $\omega$ the angular velocity of the nips to compensate for variations in $T_1$ and $T_2$, the tensions upstream and between the nips, in accordance with that expression.

The means to cause the ratio of the linear speed of the web through the second nip to that through the first nip to be a constant and have a value greater than one are achieved by arranging for the driven rollers of the two nips to have a difference in diameter with the driven roller of the second nip having a slightly greater diameter than that of the first nip and then giving the two rollers a common drive or some other means, whereby the two rollers rotate with the same angular velocity. Alternatively, the means to cause the ratio of the linear speed of the web through the second nip to that through the first nip to be a constant and to have a value greater than one may be provided by having the driven rollers of both nips the same diameter and then arranging gearing between the driven rollers to arrange for the driven roller at the second nip to have a greater angular velocity than the driven roller at a first nip by a predetermined percentage. A typical extensibility of paper, when this is the web being fed, is of the order of 0.2% and, when paper is being fed it is preferred that the linear speed of the web through the second nip is about 0.1% greater than that through the first nip.

When the web feeding machine is supplying a web processing machine which includes a nip it may be desirable to control the speed of the web processing machine to take account of the output of the web feeding machine.

Usually, the processing machine downstream from the web feeding machine can be arranged to operate at a constant rate and therefore the constant flow rate of the web through the web feeding machine is set to correspond with the flow rate of the downstream web processing machine.

A particular example of a web feeding machine for feeding paper from a storage reel to a printing press forming the first stage of a web processing plant is shown in the accompanying drawing which is a diagram of the first stage of the processing plant.

A web of paper 10 is fed from a supply reel 12 to a first tension sensing unit 14, to a first pair of nip rollers 28, then to a second tension sensing unit 16 and a second pair of nip rollers 30. The web of paper is then fed to a printing unit 18 and from there to the remainder of the web processing plant, which may include further printing units.

The first tension sensing unit 14 comprises a pair of freely rotatable idler rollers 22 and 24 and a freely rotatable roller 20 biased in a direction away from the idler rollers 22 and 24. The tension in the web of paper 10 urges the roller 20 towards the idler rollers 22 and 24 and this tension $T_1$ is monitored by a sensor unit 25 which provides an output signal representative of the tension in the web of paper 10. The second tension sensing unit 16 is located between the two pairs of nip rollers 28 and 30 and therefore simply comprises a freely rotatable roller 26 which is urged towards the nip rollers 28 and 30 by the tension in the web between the nip rollers 28 and 30. The tension sensing unit 16 also includes a sensor 31 which monitors the tension $T_2$ in the web and provides an output signal representative of the tension $T_2$. Suitable tension sensing units for the units 25 and 31 are model No. KIS 2 made by Bofors AB of Sweden.

Each pair of nip rollers includes a larger diameter driven roller and a smaller diameter roller urged against it to ensure that no slip of the paper occurs in the nip between the two rollers of each pair. The driven roller of the second pair of nip rollers 30 has a slightly larger diameter than the driven roller of the first pair of nip rollers 28 by about 0.1% and the two driven rollers are coupled together so that they rotate with the same angular velocity and are driven by a drive unit 32 which may be a variable gearbox such as a type F10 manufactured by Carter of the UK.

The machine also includes a control system 36 which includes a microprocessor. The microprocessor is based on a device model No. 9900 manufactured by Texas Instruments of the United States of America and the control system is available from Crosfield Electronics as part number 7308300. The control system 36 receives the signals from the first tension sensing unit 25 and the second tension sensing unit 31, receives an input giving the required constant flow rate of the web L which may be preselected or may be taken from the speed of the first printing unit 18 via an angular velocity sensor 37, and then the control system 36 establishes the required angular velocity $\omega$ of both pairs of driven rollers so that the following equation is satisfied.

Angular velocity of the driven rollers $\omega$:

$$\omega = L\,\frac{B\,T_2 - T_1}{A\,(T_2 - T_1)}$$

where A and B are constants.

The control system 36 also receives an input from an angular velocity sensor 34 which gives an indication of the angular velocity of the driven rollers 28 and 30, and compares this with the required value $\omega$. In the event of a difference existing between these, the control system 36 varies the speed of the drive unit 32 to vary the angular velocity of the driven rollers 28 and 30 until it is the same as that required. The angular velocity sensors 34 and 37 are preferably Revtel type RA 6009, available in the UK from RHP Bearings.

Thus, the output of the second pair of nip rollers 30 provides a constant length flow rate of the paper web 10 when this is measured at zero tension. With such a feed upstream from the printing unit 18 the tension in the web upstream from the printing unit varies in accordance with changes in the parameters of the web 10 so that, after printing by the printing unit 18 the final stabilised printed copies have a substantially constant repeat length again when measured at zero tension.

I claim:

1. A web feeding machine for controlling the feed of a web of material comprising:

a first pair of rollers bearing against one another to form a first nip;

a second pair of rollers bearing against one another to form a second nip, said second nip being located downstream from said first nip;

means to cause the ratio of the linear speed of said web through said second nip to the linear speed of said web through said first nip to be a constant and to have a value greater than one;

variable speed drive means for driving said nip rollers;

first tension monitoring means for monitoring the tension $T_1$ in said web upstream from said first nip;

second tension monitoring means for monitoring the tension $T_2$ between said first and said second nip; and, control means to control said variable speed drive of said first and said second pairs of rollers whereby their angular velocity $\omega$ satisfies the expression:

$$\frac{\omega A(T_2 - T_1)}{B\,T_2 - T_1} = C$$

where A, B and C are constants.

2. The web feeding machine of claim 1, wherein said means to cause said ratio of said linear speed of said web through said second nip to said linear speed of said web through said first nip to be a constant and greater than one includes said driven rollers of said two nips having a difference in diameter with said driven roller of said second nip having a slightly greater diameter than said driver roller of said first nip, and means to ensure that said two rollers rotate with the same angular velocity.

3. The web feeding machine of claim 1, wherein said means to cause said ratio of said linear speed of said web through said second nip to said linear speed of said web through said first nip to be a constant and to have a value greater than one is provided by having said driven rollers of both of said nips the same diameter and having said variable speed drive means include gearing between said two driven rollers whereby said driven roller at said second nip has a greater angular velocity than said driven roller at said first nip.

4. The web feeding machine of claim 1, 2 or 3, wherein said linear speed of said web through said second nip is substantially 0.1% greater than said linear speed of said web through said first nip.

* * * * *